US011293262B2

(12) United States Patent
Hiorth et al.

(10) Patent No.: US 11,293,262 B2
(45) Date of Patent: Apr. 5, 2022

(54) WELL TOOL DEVICE FOR OPENING AND CLOSING A FLUID BORE IN A WELL

(71) Applicant: Interwell Norway AS, Hafrsfjord (NO)

(72) Inventors: Espen Hiorth, Trondheim (NO); Stig Ove Bjørgum, Voss (NO)

(73) Assignee: Interwell Norway AS, Hafrsfjord (NO)

( * ) Notice: Subject to any disclaimer, the term of this patent is extended or adjusted under 35 U.S.C. 154(b) by 86 days.

(21) Appl. No.: 16/621,127

(22) PCT Filed: Jun. 13, 2018

(86) PCT No.: PCT/EP2018/065635
§ 371 (c)(1),
(2) Date: Dec. 10, 2019

(87) PCT Pub. No.: WO2019/011563
PCT Pub. Date: Jan. 17, 2019

(65) Prior Publication Data

US 2020/0115989 A1 Apr. 16, 2020

(30) Foreign Application Priority Data

Jul. 12, 2017 (NO) ..... 20171157

(51) Int. Cl.
*E21B 34/06* (2006.01)
*E21B 33/12* (2006.01)
(Continued)

(52) U.S. Cl.
CPC ..... *E21B 34/063* (2013.01); *E21B 33/1208* (2013.01); *E21B 34/10* (2013.01);
(Continued)

(58) Field of Classification Search
CPC ..... E21B 34/14; E21B 34/063; E21B 34/103; E21B 34/10; E21B 2200/06; E21B 33/1208
See application file for complete search history.

(56) References Cited

U.S. PATENT DOCUMENTS 3,552,718 A 1/1971 Schwegman
5,479,986 A * 1/1996 Gano ..... E21B 23/00 166/292
(Continued)

FOREIGN PATENT DOCUMENTS

EP 2978926 2/2016
NO 338289 B1 8/2016
(Continued)

OTHER PUBLICATIONS

International Search Report issued in PCT/EP2018/065635 dated Oct. 30, 2018 (5 pages).
(Continued)

*Primary Examiner* — Nicole Coy
(74) *Attorney, Agent, or Firm* — Osha Bergman Watanabe & Burton LLP

(57) ABSTRACT

The present invention relates to a well tool device (1) comprising a housing (10) having an axial through bore (11). A sleeve section (20) is releasably connected to the housing (10) in the through bore (11). The sleeve section (20) comprises an axial bore (21) and a frangible disc (30) provided in the bore (21) of the sleeve section (20) in sealing engagement with the sleeve section (20). The sleeve section (20) is axially displaceable within the bore (11) between a first position (P1) and a second position (P2). The housing (10) comprises an axial bypass fluid passage (12) provided axially between a first location (L1) above the sleeve section (20) to a second location (L2) below the sleeve section (20) when the sleeve section (20) is in the first position (P1). The
(Continued)

Figure 1C:
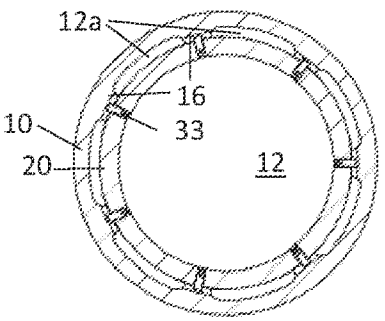

axial bypass fluid passage (12) is provided radially between the sleeve section (20) and the housing (10) when the sleeve section (20) is in the first position (P1). The well tool device (1) comprises a sealing device (36) provided radially between the sleeve section (20) and the housing (10) when the sleeve section (20) is in the second position (P2).

13 Claims, 4 Drawing Sheets

(51) Int. Cl.
*E21B 34/14* (2006.01)
*E21B 34/10* (2006.01)

(52) U.S. Cl.
CPC ..... *E21B 34/103* (2013.01); *E21B 34/14* (2013.01); *E21B 2200/06* (2020.05)

(56) References Cited

U.S. PATENT DOCUMENTS 5,685,372 A * 11/1997 Gano ..... E21B 23/00 166/292
8,490,688 B2 * 7/2013 Gaudette ..... E21B 33/127 166/130
9,732,579 B2 * 8/2017 Hiorth ..... E21B 33/1208
9,926,745 B2 * 3/2018 Bulloch ..... E21B 34/10
10,480,248 B2 * 11/2019 Bulloch ..... E21B 29/06
10,683,728 B2 * 6/2020 Kellner ..... E21B 21/103
10,808,489 B2 * 10/2020 Hiorth ..... E21B 33/134
2011/0247833 A1 * 10/2011 Todd ..... E21B 34/063 166/386
2013/0292133 A1 * 11/2013 Thompson ..... E21B 34/14 166/373
2017/0335657 A1 * 11/2017 Abney ..... E21B 33/14
2018/0313183 A1 * 11/2018 Hiorth ..... E21B 33/12

FOREIGN PATENT DOCUMENTS

NO 340798 B1 6/2017
WO 2012/066282 A2 5/2012

OTHER PUBLICATIONS

Written Opinion of the International Searching Authority issued in in PCT/EP2018/065635 dated Oct. 30, 2018 (7 pages).
Norwegian Search Report issued in No. 20171157 dated Nov. 25, 2017 (2 pages).
Interwell; "Product Sheet: Inter Remote Shatter Valve (IRSV)"; Rev. 4.0; www.interwell.com; Sep. 27, 2016 (2 pages).

* cited by examiner

WELL TOOL DEVICE FOR OPENING AND CLOSING A FLUID BORE IN A WELL

FIELD OF THE INVENTION

The present invention relates to a well tool device for opening and closing a fluid bore in a well. In particular, the present invention relates to a well tool device having a temporary open state, a temporary closed state and a permanent open state.

BACKGROUND OF THE INVENTION

In different types of well operations, it is a need for well tool devices having a valve function, i.e. the well tool device needs to be reconfigured between an open state and a closed state.

Typically, the closed state is used for pressure testing purposes to ensure that the well integrity is intact. The open state is typically during production, to allow hydrocarbon fluids to be transported from the well to the topside of the well. During the installation of the completion string or tubing, it is preferred that the tubing is open, so well fluid can flow into the tubing during the lowering of the tubing into the well.

When the tubing is landed in the well head and the pressure control equipment is installed above the tubing/well head, it is desired to replace the heavy well fluid with a lighter completion fluid before the production packer is installed. In such a case, completion fluid is pumped down into the tubing and return fluid is received through the annulus. Again, during such operations, the tubing must be open.

In some operations, the open state is also used for pressure testing purposes.

There are a number of known well tools with sliding valves, where a sleeve is axially displaced in relation to a housing for opening and closing of radial openings in the well tool. One such example is known from U.S. Pat. No. 3,552,718.

WO 2012066282 discloses a valve assembly which is configured to be coupled to a tubing string comprises a housing defining a housing flow path for communicating with the tubing string, and a barrier member located in the housing and configurable between a normally-closed position in which the barrier member restricts access through the housing flow path, and an open position in which access is permitted through the housing flow path. The axial barrier is formed by a flapper valve. The valve assembly also comprises a bypass arrangement reconfigurable between an open state in which the bypass arrangement defines a bypass flow path that communicates with the housing flow path on opposite sides of the barrier member to permit fluid to bypass the barrier member and thereby fill the tubing string, and a closed state in which fluid is prevented from bypassing the barrier member to thereby permit pressurization of the tubing string. To open the flapper valve, the pressure of fluid in the wellbore is raised to rupture a burst disc provided in the housing, to permit pressurized wellbore fluid to flow into the bore and act upon the annular piston member thereby urging an actuation sleeve upwardly towards its uppermost position and engaging the barrier member, thereby causing a shear pin to shear and permit the flapper valve to be pivoted open.

Another such known well tool device is the Inter Remote Shutter Valve (IRSV), marketed by Interwell. The IRSV is initially closed and may be connected to the lower part of the completion string. When the completion string is installed, the completion string above the IRSV may be pressure tested to ensure that the production tubing is properly installed. After testing, the IRSV is opened by crushing a glass disc within the IRSV. When open, it is possible to test the production packer outside of the completion string before production starts.

The IRSV may also be used in other well tools, such as plugs (for example the Interwell ME plug, the Interwell HPHT plug etc).

The IRSV is described in the "Product Sheet: Inter Remote Shatter Valve (IRSV)" Rev. 4.0 dated 27 Sep. 2016.

It is also known to use ball valves in the lower end of the completion string, for testing of the production tubing and the production packer. However, if the ball valve fails, it is needed to mill out the ball valve or to remove the completion string. None of these operations is desired. Moreover, such valves often have a increased outer diameter or a reduced inner diameter. An increased outer diameter will make it difficult to insert the completion string, while a reduced inner diameter will reduce the flow rate capacity of the completion.

One object of the present invention is to add functionality to the IRSV above. One such added functionality is to provide the IRSV with an initial open state. Hence, it is achieved that it is not necessary to fill fluid into the completion when adding new pipe sections to the completion string.

Another object of the invention is to achieve a well tool device where the inner diameter is not substantially reduced or where the outer diameter of the device is not substantially increased. Accordingly, the object is that the outer diameter of the well tool device is equal to or substantially equal to the outer diameter of the completion string the device is connected to, and that the inner diameter of the well tool device is equal to or substantially equal to the inner diameter of the completion string the device is connected to.

To save time and resources, the completion string is run into the drilling fluid. After the installation of the completion string, the drilling fluid is circulated out and replaced by a completion fluid before the production packer is set. A circulation valve is here typically needed. Such a circulation valve can be omitted with an initial open IRSV as part of the completion string.

In some wells with a low reservoir pressure, a light weight fluid is often circulated into the completion string before the well is opened for production, as this light weight fluid will contribute to production flowing out from the reservoir. Also in such a case it is preferred to have an initial open completion string

SUMMARY OF THE INVENTION

The present invention relates to a well tool device comprising a housing having an axial through bore, where the well tool device is comprising:

- a sleeve section releasably connected to the housing in the through bore, where the sleeve section comprises an axial bore;
- a frangible disc provided in the bore of the sleeve section in sealing engagement with the sleeve section;

where the sleeve section is axially displaceable within the bore between a first position and a second position;

where the housing comprises an axial bypass fluid passage provided axially between a first location above the sleeve section and a second location below the sleeve section when the sleeve section is in the first position, where the axial bypass fluid passage is provided radially between the sleeve section and the housing when the sleeve section is in the first position;

where the well tool device comprises a sealing device provided radially between the sleeve section and the housing when the sleeve section is in the second position.

Hence, the well tool device has an initial, or first, open state, and a subsequent, or second, closed state. In this subsequent closed state, the frangible disc is still intact. Hence, by disintegrating the frangible disc, the disc can be removed. Hence, the well tool device has a final, or third, open state.

In one aspect, the axial bypass fluid passage is provided as a widened section in the radial direction of the bore of the housing, where a height of the widened section of the bore is higher than a height of the sleeve section.

In one aspect, the axial bypass fluid passage is provided as a plurality of axial bypass fluid passages separated by axial sleeve guides.

In one aspect, the well tool device comprises a pre-compressed locking ring provided in a recess in an outer surface of the sleeve section, and where the locking ring is configured to be engaged in a recess in the bore in the second position.

The axial displacement of the sleeve section from the first position to the second position is preferably performed by pumping fluid at a fluid rate sufficiently high to build up a pressure difference over the sleeve section with the frangible disc, thereby causing the sleeve section to be released from the housing and to be displaced axially. Alternatively, the axial displacement is performed by means of a pushing tool, such as a drill pipe with a soft end section or a wireline weight tool with a soft end section.

The axial displacement of the sleeve section may be stopped by means of a protrusion into the bore of the housing, which prevents further axial displacement of the sleeve section. This protrusion may be formed by a first supporting sleeve. Hence, in one aspect, the well tool device comprises a first supporting sleeve fixed to the housing in the through bore, where the first supporting sleeve comprises an upwardly facing surface configured to support a lower end of the sleeve section when the sleeve section is in the second position. Hence, this upwardly facing surface will also stop the downwardly directed axial movement of the sleeve section. Alternatively, other types of protrusions into the bore may be used to stop the sleeve section in the second position.

In one aspect, the well tool device comprises a second supporting sleeve provided radially inside of, and releasably connected to, the first supporting sleeve, where the second supporting sleeve comprises an upwardly facing surface configured to support the frangible disc when the sleeve section is in the second position.

In one aspect, the well tool device comprises a disintegration device fixed to the housing; where the frangible disc is configured to be displaced downwardly into contact with the disintegration device when the second supporting sleeve is released from the first supporting sleeve.

Alternatively, the frangible disc may be disintegrated by means of a separate disintegration tool, such as a spear or other type of sharpened tool which will initiate a disintegration of the frangible disc.

DETAILED DESCRIPTION

Figure 1D:
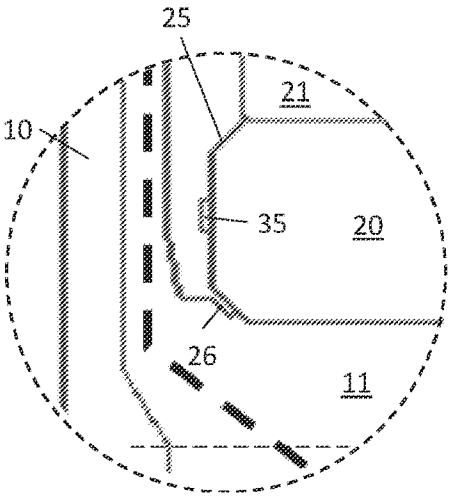
Figure 1B:
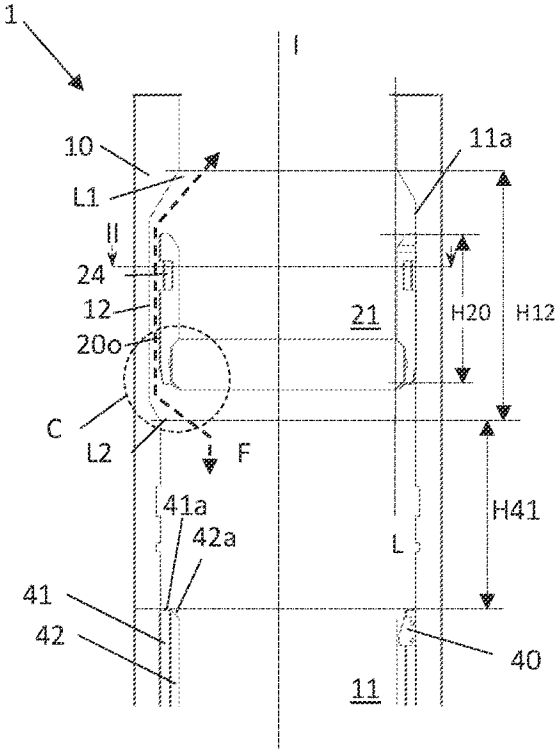
Figure 1A:
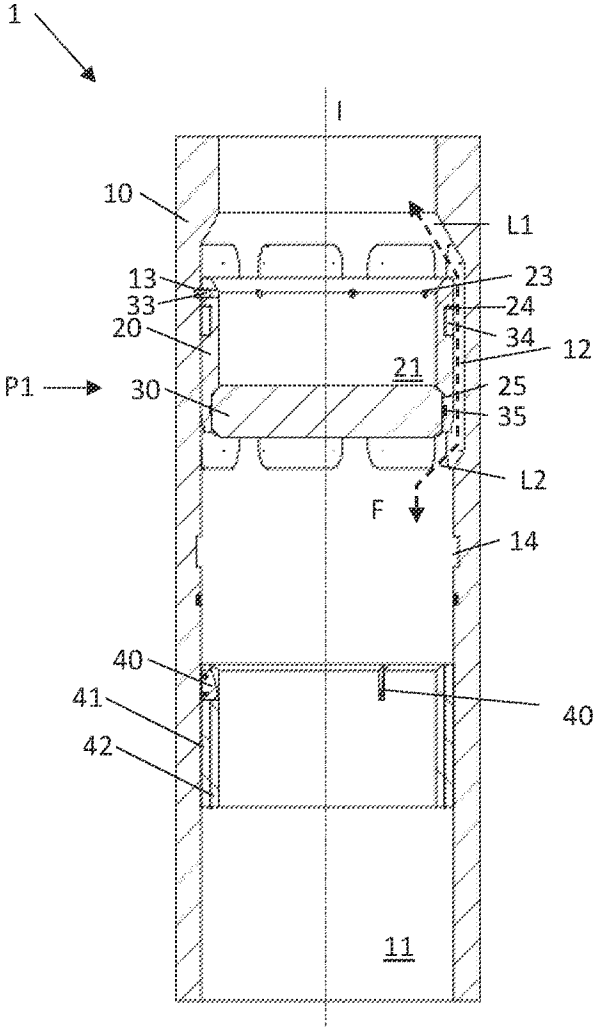

Embodiments of the present invention will now be described with reference to the enclosed drawings, where:

FIG. 1*a* illustrates a cross sectional side view of the present invention in an initial state;

FIG. 1*b* illustrates a simplified version of FIG. 1*a;*

FIG. 1*c* illustrates a cross sectional top view along line II in FIG. 1*b;*

FIG. 1*d* is an enlarged view of the dashed circle C in FIG. 1*b;*

Figure 2B:
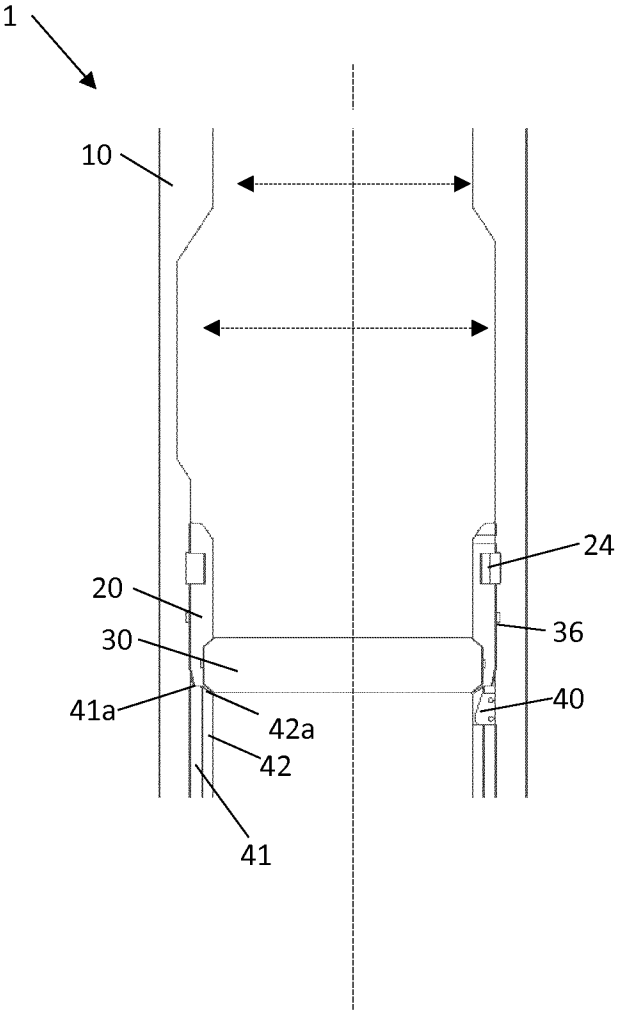
Figure 2A:
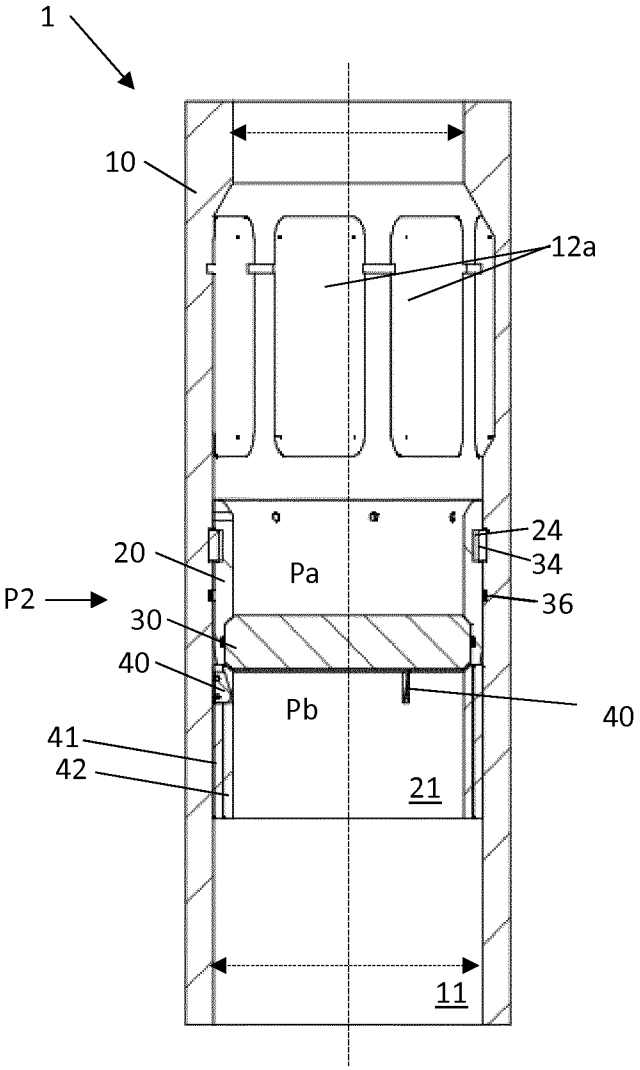

FIG. 2*a* illustrates a cross sectional view of the present invention in a subsequent state;

FIG. 2*b* illustrates a simplified version of FIG. 2*a;*

Figure 3B:
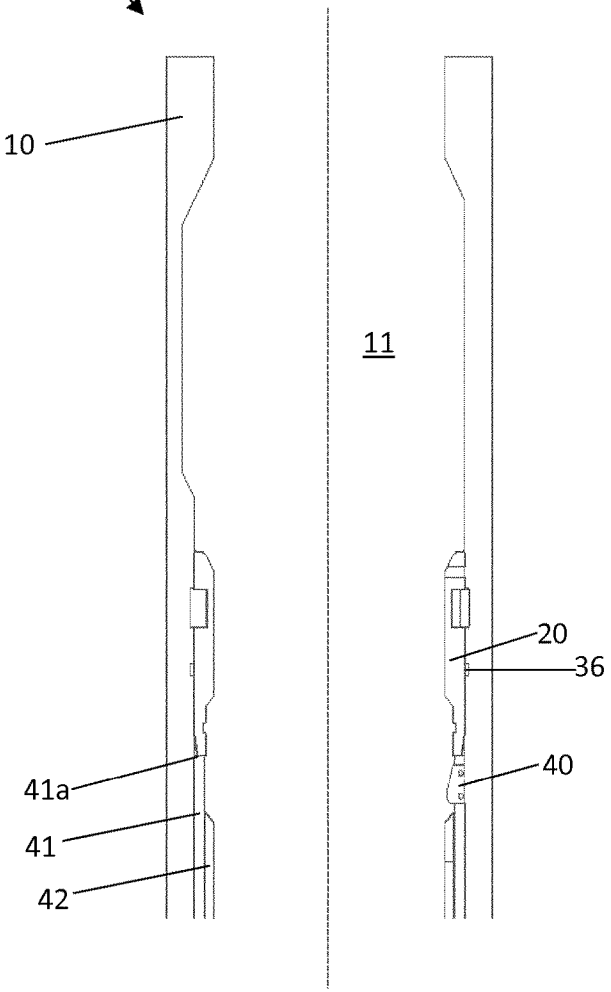
Figure 3A:
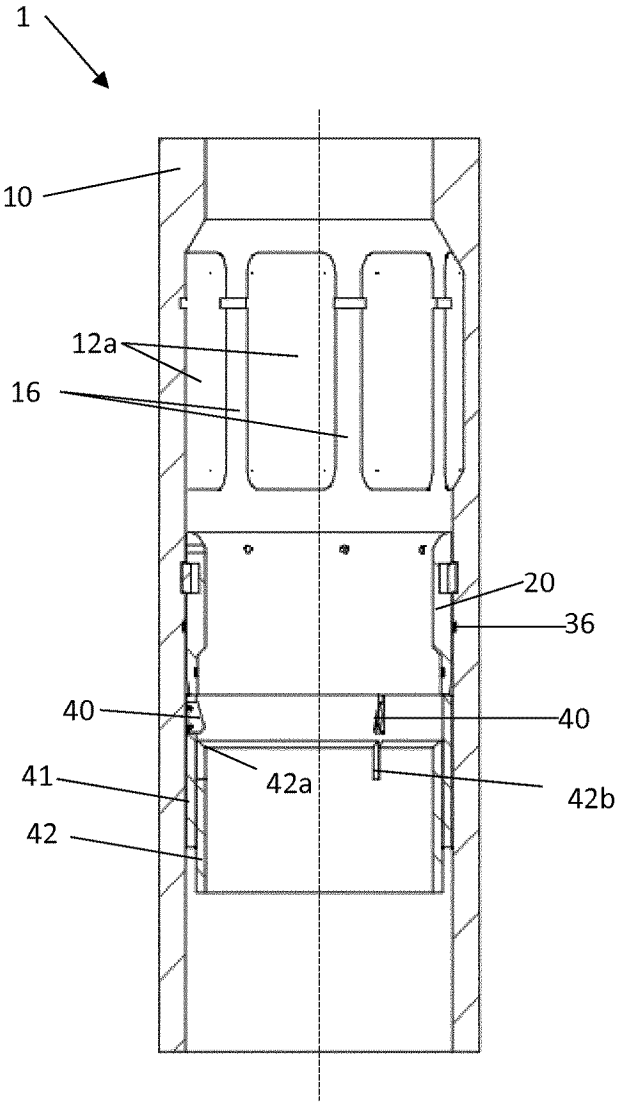

FIG. 3*a* illustrates a cross sectional view of the present invention in a final state;

FIG. 3*b* illustrates a simplified version of FIG. 2*a;*

Figure 4:
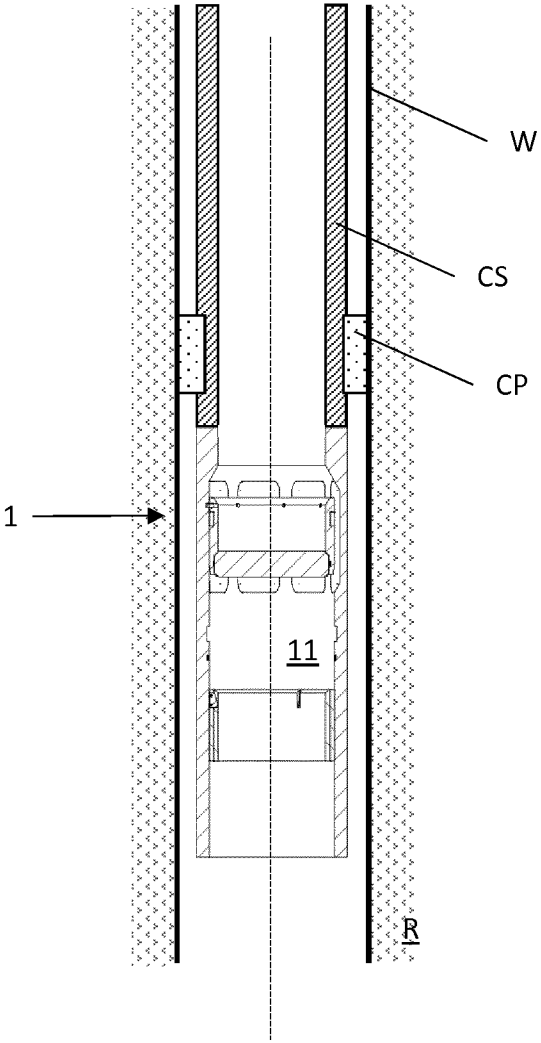

FIG. 4 illustrates the present invention connected in the lower end of a completion string.

It is now referred to FIGS. 1*a*, 1*b* and 1*c*. Here, a well tool device 1 is shown. In the drawings, the upwardly facing parts of the well tool device 1 is facing towards the upper part of the well, i.e. topside, while the downwardly facing parts of the well tool device 1 is facing towards the lower part of the well.

The well tool device 1 comprises a housing 10 having an axial through bore 11. The housing 10 is preferably a part of a completion string, a part of a production tubing or a part of a mandrel of a well plug. Hence, the well tool device 1 may be an independent well tool serving a specific purpose, or the well tool device 1 may be a part of another well tool having several purposes.

The housing 10 comprises an axial bypass fluid passage 12 provided axially between a first location L1 and a second location L2. In FIG. 1*b*, it is shown that the distance or height between the first location L1 and the second location L2 is indicated as H12. The axial bypass fluid passage 12 is provided as a widened section 11*a* in the radial direction of the bore 11. In FIG. 1*c*, it is shown that the axial bypass fluid passage 12 is provided as a plurality of axial bypass fluid passages 12*a* separated by axial sleeve guides 16. There are seven axial sleeve passages 12 and seven axial sleeve guides 16 in FIG. 1*c*.

The well tool device 1 further comprises a sleeve section 20 releasably connected to the housing 10 in the through bore 11. The sleeve section 20 is releasably connected to the housing 10 in a position hereinafter referred to as a first position P1 shown in FIG. 1*a*.

The outer surface of the sleeve section 20 is preferably in contact with the axial sleeve guides 15 of the housing 10. The sleeve section 20 is for example connected to the housing 10 by means of shear pins, shear studs or shear screws 33, where such shear screws 33 are known to shear off at a predetermined load. As shown in FIGS. 1*c* and 1*a*, each shear screw 33 is connected to screw openings 13, 23 provided in the axial sleeve guides 16 of the housing 10 and the sleeve section 20 respectively.

The sleeve section 20 has a height indicated as H20 in FIG. 1*b*, where the height H20 is smaller than the height H12 of the axial bypass fluid passage 12, i.e. than the distance between the first and second locations L1, L2.

The sleeve section 20 comprises an axial bore 21. Preferably, the axial bore 21 is aligned with the bore 11 of the housing 10 above the first location L1, as indicated by line L in FIG. 1*b*.

The sleeve section 20 comprises a seat 25 radially inside of the bore 21. A frangible disc 30 is provided in the seat 25 of the bore 21 of the sleeve section 20 in sealing engagement with the sleeve section. The sealing engagement is achieved by a sealing element 35, such as an o-ring, provided in the seat 25 between the sleeve section 20 and the frangible disc 30. Hence, in FIG. 1*a*, 1*b*, 1*c*, fluid flow is not possible through the bore 21 of the sleeve section 20 due to the frangible disc 30 and the sealing element 35. The seat 25 is provided in the lower end of the sleeve section 20. Hence, the frangible disc 30 is inserted into the seat 25 of the sleeve section 20 from below.

It should be noted that the sleeve section 20, below the seat 25 or as part of the seat 25, comprises a locking body 26 to prevent unintentional, downwardly directed movement of the frangible disc 30 in relation to the seat 25. The locking body 26 is shown in FIG. 1*d*. The locking body 26 can be provided as a part of the sleeve section 20, which are bent away during insertion of the frangible disc 30 into the seat 25, during the assembly operation of the well tool device 1 and which are bent towards the position of FIG. 1*d* after the insertion of the frangible disc 30 into the seat 30. The frangible disc is assembled with the sleeve section 20 before the sleeve section 20 and the frangible disc is inserted into the housing 10. It should be noted that if a sufficient downwardly directed force is applied to the frangible disc 30, the locking body 26 will be deformed and the frangible disc 30 will be pressed downwardly and out from the seat 25.

Hence, when the sleeve section 20 is connected to the housing 10 in the first position P1 of FIGS. 1*a*, 1*b* and 1*c* and the device 1 is lowered into the well, fluid flowing through the bore 11 must pass through the axial bypass fluid passage 12 axially between the first location L1 and the second location L2 and radially between the sleeve section 20 and the housing 10, i.e. radially outside of the sleeve section 20. This fluid flow is indicated by a dashed arrow F. It should be noted that this arrow F is bi-directional, indicating that fluid is allowed in both directions.

Accordingly, the device 1 of FIGS. 1*a*, 1*b* and 1*c* is open.

The sleeve section 20 is axially displaceable within the bore 11. Hence, when the releasable connection to the housing 10 is released, for example by the shear screws being sheared off, the sleeve section 20 is allowed to be displaced downwardly. First, it should be noted that upwardly directed displacement is not allowed due to the diameter of the bore 11 above the sleeve section 20, as mentioned above with respect to the alignment of the bore 11 and the bore 21 along line L. Such an alignment makes upwardly directed displacement impossible.

The device 1 of the present embodiment is dimensioned for a maximum fluid flow of 800-1000 liters per minute through the axial bypass fluid passage 12. If the fluid flow increased further, in the present embodiment up to 1500-2000 liters per minute, the pressure difference over the sleeve section 20 will be sufficient to shear off the shear screws 13. It should be noted that this pressure difference will not press the frangible disc 30 out of its seat 25.

It should be noted that if fluid circulation is not possible, one alternative is to use a wire-line tool with weight bars and a soft end section or a drill pipe with a soft end section. The soft end section is provided to avoid undesired disintegration of the frangible disc. The soft end section may comprise a rubber body, for pushing the sleeve section 20 down by applying a sufficient force to shear of the shear screws. Again, it should be noted that this force should not press the frangible disc 30 out of its seat 25.

The downwardly directed displacement of the sleeve section 20 in relation to the housing 10 can be stopped in several ways. The position in which the sleeve section 20 is stopped is hereinafter referred to as a second position P2 shown in FIGS. 2*a* and 2*b*.

In FIG. 1*a*, FIGS. 1*b*, 2*a* and 2*b*, it is shown that the well tool device 1 comprises a first supporting sleeve 41 and a second supporting sleeve 42.

The first supporting sleeve 41 is fixed to the outer housing 10 inside the bore 11 in a position below the second location L2. The axial distance between the second location L2 and the lower supporting sleeve 41 is preferably larger than the axial height H20 of the sleeve section 20. The lower supporting sleeve 41 is configured to stop the downwardly directed movement of the sleeve section 20 by means of its upper supporting surface 41*a*. Hence, when the lower end of the sleeve section 20 is in contact with the upper supporting surface 41*a*, the supporting sleeve 20 is in the second position P2.

The well tool device 1 further comprises a disintegration device 40 fixed at a distance below the upper supporting surface 41*a* of the first supporting sleeve 41 in the bore 11 of the housing 10. Preferably, there are several such disintegration devices 40, such as two or three, distributed inside the bore 11. The disintegration device 40 can be fixed directly to the housing 10 or to the first supporting sleeve 41. The disintegration device 40 comprises vertically oriented knifes or other suitable pointy surfaces able to initiate disintegration of the frangible disc 30 when the frangible disc 30 is pushed towards the disintegration device 40. As is known, a frangible disc 30 made of hardened glass will be disintegrated into very small glass particles when such disintegration has been initiated.

The second supporting sleeve 42 is located radially inside the first supporting sleeve 41, and is releasably connected to the first supporting sleeve 41. In the present embodiment, the second supporting sleeve 42 is releasably connected to the first supporting sleeve 41 by means of a system as described in EP2978926B1, which is hereby incorporated by reference. EP2978926B1, in the name of Vosstech, a subsidiary of Interwell, describes a system where two such sleeves are allowed to move in relation to each other due to a predetermined number of pressure changes.

The second supporting sleeve 42 comprises an upper supporting surface 42*a* for supporting the frangible disc 30 when the sleeve section 20 is in the second position P2. In FIG. 3*a*, it is shown that the second supporting sleeve 42 comprises a vertical slit 42*b* in which the disintegration device 40 is located before the release of the second supporting sleeve 42 from the first supporting sleeve 41. Hence, when the supporting sleeve 20 is in its first and second position P1 and P2, the disintegration device 40 is provided in the slit 42*b* of the second supporting sleeve 42.

It is now referred to FIGS. 1*a*, 1*b*, 2*a* and 2*b* again. In the present embodiment, the well tool device 1 comprises a pre-compressed locking ring 34 provided in a recess 24 in an outer surface 20*o* of the sleeve section 20. A recess 14 is provided in the bore 11 at a desired position. In the present embodiment, the location of the lower supporting sleeve 41 is adapted to the locations of the recesses 14, 24 so that when the lower end of the sleeve section 20 is in contact with the upper supporting surface 41*a*, then the recess 14 is vertically aligned with recess 24, thereby allowing the locking ring 36 to expand. The locking ring 34 is configured to be engaged in the recess 14 in the bore 11 during or after the downwardly directed movement, thereby locking the sleeve section 20 to the housing 10 as the locking ring 34 is engaged in both the recess 24 of the sleeve section 20 and the recess 14 of the bore 11.

Hence, the sleeve section 20 is stopped in the position P2 by means of the lower supporting sleeve 41 and is locked in this position P2 by means of the locking ring 34.

The well tool device 1 further comprises a sealing device 36 provided radially between the sleeve section 20 and the housing 10 when the sleeve section 20 is in the second position P2. The sealing device 36 may be an o-ring located in a recess provided in the bore 11 below the second location L2 and above the lower supporting sleeve 41. Hence, when the sleeve section 20 is in the second position P2, fluid is prevented from flowing through the bore 11 as the sealing device 36 prevents fluid from flowing in an axial direction radially outside of the sleeve section 20. Due to the sealing element 35 provided between the frangible disc 30 and the seat of the sleeve section 20, fluid flow through bore 21 is also prevented.

Accordingly, the device 1 of FIGS. 2*a* and 2*b* is closed. Hence, if the housing 10 is a part of a completion string, it is now possible to perform a pressure testing of the completion string above the sleeve section 20.

In FIG. 2*a*, a fluid pressure Pa is indicated above the frangible disc 30, while a fluid pressure Pb is indicated below the frangible disc 30.

In FIG. 3*a* and FIG. 3*b* it is shown that the second supporting sleeve 42 has been moved downwardly in relation to the first supporting sleeve 41, by variating the pressure difference Pa/Pb, thereby actuating the system described in EP2978926B1. When the second supporting sleeve 42 has moved, the frangible disc 30 is not supported by the upper supporting surface 42*a* anymore. By increasing the pressure above the frangible disc 30, the frangible disc 30 will be pressed downwardly and cause a deformation of the locking body 26 of the sleeve section 26 until the frangible disc 20 is released from its seat 25. The frangible disc 20 will move downwardly until it meets the disintegration device 40. It should be noted that the frangible disc 30 in the present embodiment only moves about 1 mm, or a couple of mm before it meets the disintegration device 40, i.e. the frangible disc 30 does not leave it seat 25 entirely before disintegration.

In FIG. 3*a* and FIG. 3*b* it is also shown that the frangible disc 30 has been disintegrated. The bore 11 is now open and the device 1 is in an open state again.

The operation of the well tool device 1 will now be described. Initially, it is referred to FIG. 4. Here, the upper end of the well tool device 1 is connected to a lower part of a completion string CS, where the completion string CS with the well tool device 1 is inserted into a well W drilled into a oil and/or gas reservoir R.

In a first or initial step, the device 1 is open, i.e. the sleeve section 20 is in the first position P1. Fluid may be supplied at an initial fluid rate from topside and into the well W via the bore 11 of the device 1, as described with respect to FIGS. 1*a*, 1*b* and 1*c* above.

In FIG. 4, it is shown that a completion packer CP has been set between the outer surface of the completion string CS and the inner surface of the well W. As mentioned in the introduction above, fluid in the well may be replaced before the packer CS is set.

When desired, the device 1 can be brought to the closed state by moving the sleeve section 20 from the first position P1 to the second position P2. This can be done by increasing the fluid flow rate as described above, causing the shear screws 13 to be sheared off. Alternatively, this can be done by pushing the sleeve section 20 downwardly by means of the abovementioned tool with a soft end section, also causing the shear screws 13 to be sheared off.

The pressure in the completion string can now be increased to a predetermined value in order to test the integrity of the casing string CS.

If the test is successful, the operator can proceed to the next step.

In the next step, the device 1 can be brought to an open state again by releasing the second supporting sleeve 42 from the first supporting sleeve 41 and pushing the frangible disc 30 downwardly towards the disintegration device 40 causing the disintegration of the frangible disc 30. Production from the well can now start.

Alternatively, the frangible disc may be disintegrated by means of a separate disintegration tool, such as a spear or other type of sharpened tool which will initiate a disintegration of the frangible disc when lowered down onto the frangible disc.

Alternatively, the frangible disc may comprise an axial through opening sealed by an actuation device, as described in NO 338289 (B1) in the name of Vosstech. Here, disintegration is initiated by pushing the actuation device downwardly or by pulling the actuation device upwardly. In yet an alternative, the frangible disc itself may comprise an upwardly protruding neck portion, as described in NO 340798 B1 in the name of Interwell. Here, disintegration is initiated by pushing the neck portion sideways, causing it to disintegrate from the rest of the frangible disc.

The invention claimed is:

1. A well tool device, comprising a housing having an axial through bore, wherein the well tool device is comprising:

a sleeve section releasably connected to the housing in the axial through bore, wherein the sleeve section comprises an axial bore;

a frangible disc provided in the axial bore of the sleeve section in sealing engagement with the sleeve section;

wherein the sleeve section is axially displaceable within the axial through bore between a first position and a second position;

wherein the housing comprises an axial bypass fluid passage provided axially between a first location above the sleeve section and a second location below the sleeve section when the sleeve section is in the first position, wherein the axial bypass fluid passage is provided radially between the sleeve section and the housing when the sleeve section is in the first position;

wherein the axial bypass fluid passage is provided as a plurality of axial bypass fluid passages separated by axial sleeve guides each having a height larger than a height of the sleeve section;

wherein the well tool device comprises a sealing device provided radially between the sleeve section and the housing when the sleeve section is in the second position;

wherein the well tool device comprises a first supporting sleeve fixed to the housing in the axial through bore and a second supporting sleeve provided radially inside of, and releasably connected to, the first supporting sleeve.

2. The well tool device according to claim 1, wherein the axial bypass fluid passage is provided as a widened section in the radial direction of the axial through bore, wherein a height of the widened section of the axial through bore is higher than a height of the sleeve section.

3. The well tool device according to claim 2, wherein the axial bypass fluid passage is provided as a plurality of axial bypass fluid passages separated by axial sleeve guides.

4. The well tool device according to claim 2, wherein the well tool device comprises a pre-compressed locking ring provided in a recess in an outer surface of the sleeve section, and wherein the locking ring is configured to be engaged in a recess in the axial through bore in the second position.

5. The well tool device according to claim 2, wherein the first supporting sleeve comprises an upwardly facing surface configured to support a lower end of the sleeve section when the sleeve section is in the second position.

6. The well tool device according to claim 1, wherein the well tool device comprises a pre-compressed locking ring provided in a recess in an outer surface of the sleeve section, and wherein the locking ring is configured to be engaged in a recess in the axial through bore in the second position.

7. The well tool device according to claim 6, wherein the first supporting sleeve comprises an upwardly facing surface configured to support a lower end of the sleeve section when the sleeve section is in the second position.

8. The well tool device according to claim 1, wherein the first supporting sleeve comprises an upwardly facing surface configured to support a lower end of the sleeve section when the sleeve section is in the second position.

9. The well tool device according to claim 8, wherein the second supporting sleeve comprises an upwardly facing surface configured to support the frangible disc when the sleeve section is in the second position.

10. The well tool device according to claim 9, where the well tool device comprises a disintegration device fixed to the housing; wherein the frangible disc is configured to be displaced downwardly into contact with the disintegration device when the second supporting sleeve is released from the first supporting sleeve.

11. The well tool device according to claim 8, where the well tool device comprises a disintegration device fixed to the housing; wherein the frangible disc is configured to be displaced downwardly into contact with the disintegration device when the second supporting sleeve is released from the first supporting sleeve.

12. The well tool device according to claim 1, wherein the well tool device comprises a pre-compressed locking ring provided in a recess in an outer surface of the sleeve section, and wherein the locking ring is configured to be engaged in a recess in the axial through bore in the second position.

13. The well tool device according to claim 1, wherein the first supporting sleeve comprises an upwardly facing surface configured to support a lower end of the sleeve section when the sleeve section is in the second position.

* * * * *